US005407739A

United States Patent [19]

McCullough et al.

[11] Patent Number: 5,407,739

[45] Date of Patent: Apr. 18, 1995

[54] IGNITION RESISTANT MELTBROWN OR SPUNBONDED INSULATION MATERIAL

[75] Inventors: Francis P. McCullough, Lake Jackson, Tex.; Bhuvenesh C. Goswami, Clemson, S.C.; Robert T. Patton, Lake Jackson, Tex.

[73] Assignee: The Dow Chemical Company, Midland, Mich.

[21] Appl. No.: 98,659

[22] Filed: Jul. 28, 1993

[51] Int. Cl.[6] ..... B32B 5/06; B32B 5/22

[52] U.S. Cl. ..... 428/287; 2/1; 2/2; 2/69; 264/211.12; 264/211.13; 264/211.14; 297/452.16; 428/284; 428/288; 428/296; 428/297; 428/303; 428/408; 428/903; 428/920; 428/921

[58] Field of Search ..... 428/288, 296, 297, 303, 428/409, 903, 284, 287, 920, 921; 264/211.12, 211.13, 211.14; 2/1, 69, 2; 297/452.16

[56] References Cited

U.S. PATENT DOCUMENTS

| | | | |
|---|---|---|---|
| 4,118,531 | 10/1978 | Hauser | 428/224 |
| 4,294,876 | 10/1981 | Camden et al. | 428/95 |
| 4,433,024 | 2/1984 | Eian | 428/198 |
| 4,681,801 | 7/1987 | Eida et al. | 428/283 |
| 4,756,941 | 7/1988 | McCullough et al. | 428/95 |
| 4,837,076 | 6/1989 | McCullough, Jr. et al. | 428/224 |
| 4,879,168 | 11/1989 | McCullough, Jr. et al. | 428/229 |
| 4,898,783 | 2/1990 | McCullough et al. | 428/408 |
| 5,024,877 | 6/1991 | McCullough et al. | 428/282 |

*Primary Examiner*—James D. Withers

[57] ABSTRACT

An ignition resistant fibrous material for use as insulation. The material comprises a multiplicity of meltblown or spunbonded thermoplastic filaments in combination with a multiplicity of nonlinear, nongraphitic carbonaceous fibers. The carbonaceous fibers have a Young's modulus of greater than 300,000 psi and reversible deflection ratio of greater than 1.2:1.

35 Claims, 1 Drawing Sheet

IGNITION RESISTANT MELTBROWN OR SPUNBONDED INSULATION MATERIAL

FIELD OF THE INVENTION

The present invention relates to an ignition resistant fibrous insulation material comprising a multiplicity of thermoplastic polymeric fibers prepared by a meltblown or spunbonded process in combination with nonlinear carbonaceous fibers. Recyclable polymeric products, such as polyester containers, are particularly useful as a source of raw materials for preparing the meltblown or spunbonded polymeric fibers.

BACKGROUND OF THE INVENTION

Nonwoven materials are made by the bonding of web like arrays of fibers or filaments. The materials can be made from staple fibers of discreet lengths by carding, wet laying, or the like, or they can be produced by laying or blowing filaments as they are melt extruded. The nonwoven materials made by these latter processes are commonly known as spunbonded or spunlaid and meltblown materials. More particularly, spunbonded materials are generally produced as continuous filaments to form fibrous materials such as fabrics, webbing, sheets, films, tapes, and the like. Meltblown materials are produced by a process in which extremely fine or super fine fibers of typically less than 10 microns in diameter are extruded under the influence of a dynamic flow of air and are collected on a screen or belt in the form of a nonwoven web or batt. As a result of the dynamic air flow, the fibers are drawn so that there is obtained a difference in birefringence, crystallinity and molecular orientation as compared to conventionally spun fibers.

Fibrous materials containing various polymeric fibers are, of course, well known in the prior art. Processes for preparing such fibrous materials from thermoplastic materials using a meltblown process have been described in publications such as Naval Research Laboratory Report (NRL) 30 No. 111437 of Apr. 15, 1954; NRL Report 5265 of Feb. 11, 1959, and Industrial and Engineering Chemistry, Vol. 48, No. 8 (1956), pages 1,342–1,346. Meltblown processes are also described in U.S. Pat. Nos. 2,374,540; 2,411,659; 2,411,660; 2,437,363 and 3,532,800. Methods for preparing spunbonded articles are described in British Pat. Nos. 1,055,187 and 1,215,537 and in U.S. Pat. Nos. 3,379,811 and 3,502,763.

U.S. Pat. No. 4,118,531 to Hauser, which is incorporated herein by references, discloses meltblown webs that comprise a mixture of microfibers and crimped bulking fibers which are used for thermal insulation. These webs are sold as Thinsulate TM by Minnesota Mining and Manufacturing Corporation, an insulation for clothing articles. However, the insulation is highly flammable and does not have the characteristic of reloft.

As is well known, meltblown materials have found utility in a broad range of applications. For example, it is known to use meltblown filaments, particularly those obtained from thermoplastic resins, in the preparation of battery separators, cable wrap, capacitor insulation paper, as wrapping materials, clothing liners, diaper liners, in the manufacture of bandages and sanitary napkins, and the like.

The problem with the prior art meltblown materials is that the large amount of thermoplastic materials utilized in the manufacture of the meltblown materials, Such as battings, render the battings highly flammable and particularly so because of the small diameter fibers, of less than 10 micrometers, that are utilized to provide an increase in surface area when compared to conventional fibers.

U.S. Pat. No. 4,837,076, by McCullough et al., which is herein incorporated by reference, discloses crimped, irreversibly heat set, carbonaceous fibers having a reversible deflection ratio of greater than 1.2:1 which can be used in preparing the fibrous materials of the invention.

U.S. Pat. No. 4,879,168 to McCullough et al. discloses an ignition resistant structure wherein conventionally spun thermoplastic fibers are blended with carbonaceous fibers. However, the thermoplastic fibers are of a relatively large diameter on the order of from 15 to 25 microns and, accordingly, are not as efficient for use as a thermal insulating material as compared to the meltblown fibrous materials of the invention. In the area of building insulation, the meltblown fibrous material of the invention is particularly effective as a thermal insulating material when compared to fiberglass.

It is understood that the term "fibrous material" as used herein refers to a multiplicity of randomly entangled fibers in the form or shape of a nonwoven sheet, fabric, web, batt, or the like, depending upon the loft and density of the material. The fibrous material can be in the form of a single ply or a multiplicity of superimposed or stacked plies.

The term "reloft" defines the ability of the fibrous material to return to its original dimension after the material has been subjected to a compression load of 15 psi for one hour at ambient temperature.

The term "microfiber" or "fibrils" used herein is well known in the fiber arts and is generally applicable to all polymeric fibers having an average diameter of less than 15 microns and, typically, less than 10 microns.

The term "crimp" generally defines the wariness or nonlinearity of a fiber expressed in the number of waves per unit length and and its amplitude. The wariness of the fiber can include different symmetrical or nonsymmetrical configurations such as sinusoidal, coil like, and the like.

The term "reversible deflection" or "working deflection" generally applies to helical or sinusoidal compression springs and is applicable to the crimped fibers employed in the present invention. Particular reference is made to the publication "Mechanical Design-Theory and Practice" MacMillan Pub Co., 1975, pp. 719 to 748: particularly Section 14-2, pages 721 to 724.

The carbonaceous fibers that are employed in the present invention are produced from polymeric precursor fibers such as, for example, oxidized polyacrylonitrile fibers, by heat treating the fibers in a nonoxidizing atmosphere to render the fibers carbonaceous. The term "carbonaceous fiber" is understood to mean that the carbon content of the fiber is greater than 65% but less than 98%, preferably less than 92% by weight, and that the carbon content has been increased as a result of an irreversible chemical reaction induced by heating the polymeric precusor fibers in a non oxidizing atmosphere. Fibers having a carbon content of greater than 98% by weight are known as graphitic fibers.

The term "permanent" or "irreversibly heat set" used herein applies to nonlinear carbonaceous fibers which possess a degree of resiliency and flexibility such that the carbonaceous fibers when stretched and placed under tension to a substantially linear shape, but without exceeding the tensile strength of the fibers, will revert substantially to their nonlinear shape once the tension on the fibers is released. The foregoing terms also imply that the fibers can be stretched and released over many cycles without breaking the fibers.

The term "Pseudoextensibility" or "Pseudoelongatability" refers to the elongatability of a fiber which results from the crimped or nonlinear configuration including any false twist that is imposed on the fiber.

The term "bending strain of the crimped fiber" as used herein is as defined in *Physical Properties of Textile Fibers.*, W. E. Morton and J. W. S. Hearle, The Textile Institute, Manchester, 1975, pages 407–409. The percent bending strain resulting from the crimp on the fiber can be determined by the equation:

$$S = r/R \times 100$$

where S is the percent (%) bending strain, r is the fiber radius and R is the radius of curvature of bend. That is, if the neutral plane remains in the center of the fiber, the maximum percentage tensile strain, which will be positive on the outside and negative on the inside of the bend of the fiber, equals $r/R \times 100$ in a circular cross section of the fiber.

The term "stabilized" used herein applies to precursor fibers or fiber tows that have been oxidized at a temperature of typically less than 300° C. For acrylic fibers prior to subjecting the fibers to a heat treatment to convert the precursor fibers to carbonaceous fibers. It will be understood that, in some instances, the fibers or fiber tow can also be oxidized by chemical oxidants at a lower temperature.

SUMMARY OF THE INVENTION

The present invention resides in a novel thermal insulation and ignition resistant material comprising a combination of a multiplicity of randomly oriented thermoplastic fibers having an average diameter of less than 15 microns, preferably from about 5 to about 6 microns, when formed by a meltblown process, and from about 6 to 10 microns when formed by a spunbonded process, and a multiplicity of nonlinear, nongraphitic, carbonaceous fibers. The carbonaceous fibers have a Young's modulus of at least about 300,000 psi (about 2 GPa), a reversible deflection ratio of greater than 1.2:1, and a tenacity of from about 2 to 20 grams/denier (g/d), preferably from about 6 to 19 g/d. The carbonaceous fibers can comprise from about 1 to 90% by weight, based on the total weight of the material.

The fibrous material of the invention generally has a bulk density of from about 100 to 300 cc/g (cubic cm per gram) or, conversely, 0.01 to 0.003 g/cc (grams per cubic cm), preferably from about 200 to 300 cc/g (0.005 to 0.003 g/cc).

The preferred carbonaceous fibers of the invention are characterized by having a multiplicity of crimps along their length with an elongatability to break of from about 2 to 9 percent, a pseudoelongatability of from about 0.2 to 18 percent, and a bending strain value of less than 50 percent, preferably less than 30 percent.

The material of the invention, such as a batting, is particularly useful to provide high thermal insulation in which R is typically greater than 3/in, where R is measured in $hr \cdot ft^2 \cdot °F./BTU$. The material of the invention is also particularly useful as a fire resistant and ignition resistant insulation and can be used in lieu of fiberglass or other forms of insulation for buildings. The fibrous material of the invention can also be used as thermal and ignition resistant insulation or padding for articles for personal use such as gloves, jackets, sleeping bags, etc., as furniture upholstery and covers, curtains, comforters, mattress pads, etc., as padding for carpeting, and the like.

It is therefore an object of the invention to provide a novel ignition resistant, thermal insulating material comprising meltblown or spunbonded thermoplastic fibers in combination with nonlinear carbonaceous fibers.

It is also an object of the invention to provide a fire resistant material of polyester fibers intermingled with carbonaceous fibers throughout.

It is another object to provide ignition resistant material which can be used as thermal insulation in buildings, and the like.

The objects and advantages of the invention will become more clearly understood from the drawings and the description of the preferred embodiments.

DESCRIPTION OF THE PREFERRED EMBODIMENTS

In accordance with the invention, it has been surprisingly discovered that a fibrous material comprising a combination of a multiplicity of meltblown or spunbonded thermoplastic polymeric microfibers, having an average diameter of less than 15 microns, and a multiplicity of nonlinear, nongraphitic, carbonaceous fibers having a Young's modulus of at least about 300,000 psi (2 GPa) and a reversible deflection ratio of greater than 1.2:1, provides a material having excellent ignition resistance and thermal insulation characteristics. The carbonaceous fibers are present in an amount of from about 1 to 90% by weight, based on the total weight of the fibrous material.

Figure 1:
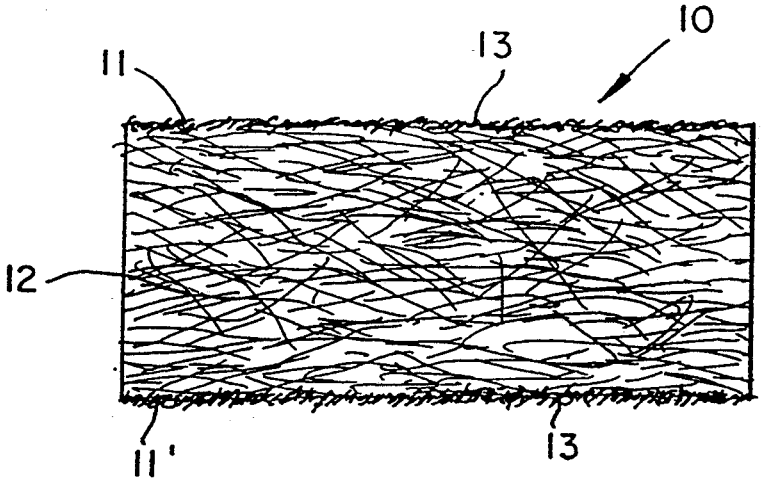
FIG. 1 is a cross sectional view of the ignition resistant fibrous insulation material of the invention in the form of a batting having a layer of carbonaceous fibers adhered to opposite surfaces of the spunbonded or meltblown polymeric fibers.

As shown in FIG. 1, a fibrous material, for example, a batting 10 of a multiplicity of meltblown or spunbonded thermoplastic polymeric filaments 12 has adhering to its outer surfaces an ignition resistant layer of nonlinear carbonaceous fibers 13. A layer 11, 11' of the carbonaceous fibers 13 can also be provided on opposite surfaces of the batting 10 so as to provide ignition resistance to both of its opposite surfaces (or to all of its exposed outer surfaces), while the microfibers 16 provide additional thermal insulation to the batting 10.

A relatively small amount of carbonaceous fibers 13 of from about 1 to 7.5% by weight, based on the total weight of the batting, when placed on an outer surface of the batting 10 will provide that surface with ignition resistance.

Figure 2:
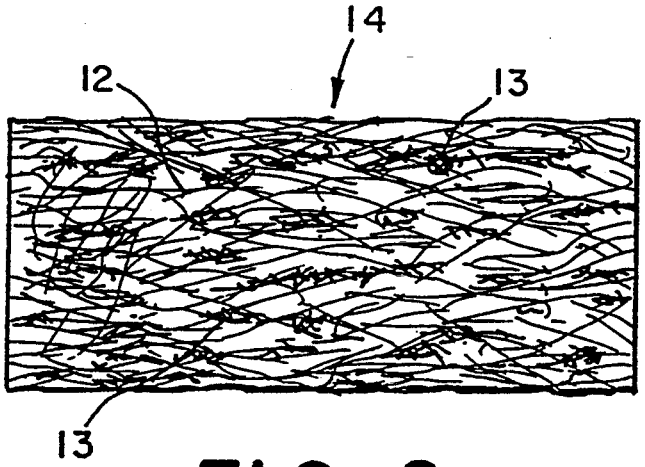
FIG. 2 is a cross sectional view of another type of fibrous material of the invention in the form of a batting in which the carbonaceous fibers are adhered to and distributed throughout the spunbonded or meltblown polymeric fibers.

FIG. 2 illustrates a batting 14 comprising a multiplicity of thermoplastic polymeric fibers 12 produced by the meltblown process having a multiplicity of nonlinear carbonaceous fibers 13 randomly distributed throughout the batting and adhering to the thermoplastic fibers 12. The carbonaceous fibers are preferably adhered to the thermoplastic fibers 12 while the thermoplastic fibers are still soft and tacky as they are extruded during the meltblowing process.

When the carbonaceous fibers 12 are distributed throughout the batting 10, a slightly larger amount of from about 10 to 20% by weight of carbonaceous fibers is sufficient and effective to provide enhanced ignition resistance to the batting. An increase in the amount of the carbonaceous fibers above 20% by weight, based on the total weight of the batting, further improves the fire resistance of the batting. Battings which contain carbonaceous fibers in an amount of from about 50 to 90% by weight have fire blocking characteristics. Fibrous materials, such as battings, which contain high amounts, for example, about 90% by weight carbonaceous fibers, are particularly suitable for use as fire blocking insulation in buildings, ships, aircraft, and the like. A high percentage of carbonaceous fibers in the material of the invention also provides superior thermal insulation in extreme climates and/or in structures to be insulated against radiant energy. When carbonaceous fibers are used that have a relatively high electrical conductivity, a material containing such carbonaceous fibers provides electromagnetic radiation shielding, such as in shielding from microwaves.

The material of the invention can be prepared utilizing known meltblowing or spunbonding apparatuses, such as are described in, for example, U.S. Pat. No. 4,118,531, which is incorporated herein by reference.

A typical production line includes an extruder fitted with a metering pump, a die assembly and a collector or conveyer. The extruder has a design essentially similar to that used in the extrusion of films and tapes. However, in a meltblown process, a special die is used which has three distinct components, viz. a thermoplastic polymer distributor, a die nosepiece and an air delivery system. The melt blown process is generally carried out at temperatures that are normally higher than a corresponding melt spinning or film extrusion process. The thermoplastic polymer is extruded through individual orifices or openings in the die having a diameter of from about 0.2 to 0.4 mm that are spaced from each other at a distance of from about 8 to 20 orifices per inch (315 to 800 orifices per meter). The die can typically vary from about 25 to 100 cm in width. The thermoplastic polymer is generally extruded into fibers at a rate of greater than about 1 g/orifice/min. It is a further aspect of the invention to provide the fibers with a noncircular cross section. Thus, the fibers can be extruded into the shape of a triangle, square, dogbone, or any other symmetrical or nonsymmetrical cross sectional shape. Extruding the fibers in shapes other than circular provides for advantages in the physical properties of the fibers.

The thermoplastic polymer melt passes from the feed distribution channel to the nosepiece. The nosepiece, which is synonymous with a spinner in a fiber spinning process, consists of a hollow, wide tapered, metal housing having a plurality of rows of orifices extending across the width of the die. Air manifolds through which hot air is supplied, are placed on the top and the bottom of the nosepiece. The air which is supplied by a conventional compressor can vary in velocity of from 0.5 to 0.8 times the speed of sound. The air temperature can be of substantially the same temperature as the die and as high as 400° C., depending on the type of thermoplastic material used. As the thermoplastic polymer is extruded through the orifices, the hot air streams, emerging from the top and bottom part of the nosepiece, attenuate, i.e. stretch and elongate, the hot polymer emerging from the die orifices. The size of the thermoplastic filaments obtained in this manner will depend on the type of polymeric material used and other processing factors, such as temperature, pressure, air velocity, etc. The meltblown thermoplastic filaments are allowed to cool down as they are being carried by the air stream away from the die and as they are deposited in a random orientation on a collector screen, perforated belt conveyor, or the like. The hot polymeric filaments extruded from the die will cool during their travel from the die to the collector screen or conveyor but will retain a sufficient amount of softness and tackiness so that they will adhere and bond to each other and to the carbonaceous fibers as the carbonaceous fibers are conveyed by a secondary warm air stream and become entrained in the attenuated streams of polymeric fibers during their travel from the die to the collector screen or conveyor. The fibrous material can then be removed from the screen for further processing.

The meltblown material of the invention can be prepared by the process similar to the process heretofor described in U.S. Pat. No. 4,118,531 to Hauser, with the exception that crimped carbonaceous fibers are used instead of the polymeric bulking fibers described in the patent.

A plurality of meltblowing extrusion dies in combination with a carbonaceous fiber delivery apparatus can be positioned in a sequential manner downstream of a first nozzle and delivery apparatus to provide a plurality of juxtaposed layers or plies of fibrous material of thermoplastic and crimped carbonaceous fibers that can be positioned one on top of the other to provide a layered structure, i.e. a batting, of any desired thickness and loft.

The material of the invention, preferably in the form of battings, can be supplied in any desired thickness depending on the particular use to be made of the material and can have a thickness from about 4 to 100 millimeters. The density of the material can also vary widely depending on the particular uses to which the material is applied, although generally the material has a density of at least 100 cubic centimeters/gram (cc/g). The insulation material of the invention has a k value of less than about 0.33 BTU·in/hr·ft$^2$·°F.

The fibrous material of the invention can include minor amounts of other ingredients in addition to the nonlinear carbonaceous fibers. For example, organosilicone products such as polysiloxanes can be added to improve the water repellency of the material. Other polymeric materials, including polymeric binders, can be added to the material to form sheets having a greater stiffness and rigidity.

Additives, such as dyes and fillers, can also be added to the material by introducing them into the polymeric fiber forming melt or into the nonlinear carbonaceous fibers.

Figure 3:
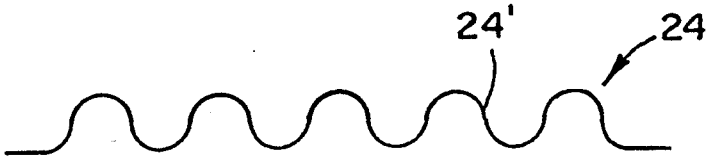
FIG. 3 is a side elevation representative of a crimped carbonaceous fiber useful in the manufacture of the fibrous material of the invention.

The smaller the diameter of the thermoplastic filaments used in the material of the invention, the better the thermal insulative effect. The nonlinear or crimped carbonaceous fibers used in the material of the invention are preferably the crimped fibers as shown in FIG. 3. That is, the crimped carbonaceous fibers are provided with a crimp frequency of about 2 crimps per inch. The crimped carbonaceous fibers have a Young's modulus of at least about 300,000 psi (2 GPa), an elongatability to break of from about 2 to 9%, a pseudoelongatability of from about 0.2 to 18%, a reversible deflection ratio greater than 1.2:1, and a bending strain value of the fiber at the crimp of less than 50 percent, preferably less than 30 percent.

In general, any of the thermoplastic resins, or mixtures thereof, that are known in the prior art are useful in the preparation of the meltblown fibers that are employed in the fibrous material of the invention. Suitable thermoplastic polymeric resins include polymers of branched and straight chained olefins such as polyethylene, polypropylene, polybutylene, polypentene, and the like. Included herein are various copolymers of ethylene and propylene or copolymers of ethylene with unsaturated esters of carboxylic acids. Especially, useful are copolymers of ethylene with vinylacetate or alkyl acrylates, for example, methyl acrylate and ethyl acrylate. These ethylene copolymers typically comprise from about 60 to 97% by weight ethylene, preferably from about 70 to 90% by weight ethylene. Copolymers of propylene include copolymers of propylene and ethylene and propylene and an alpha olefin containing from 4 to 16 carbon atoms. Suitable polypropylene and propylene copolymers can be highly crystalline isostatic or syndiotactic. The density of these polymer can be from about 0.8 to 0.95 g/cc.

A preferred thermoplastic resin of the invention is polypropylene, especially, a polypropylene having a number average molecular weight of from about 10,000 to 13,000, preferably about 11,300. These polypropylene polymers can be used to provide battings with fine denier fibers or fibrils.

Polyesters, such as polyethylene terephthalate, are advantageously obtained from recycled waste products such as containers used for numerous consumer products, and are particularly useful in providing a fibrous material which is inexpensive to produce and environmentally attractive in preventing the accumulation of plastic waste.

Other polymeric materials such as polyvinylidene chloride or cardable glass microfibers can also be used to enhance the physical properties of the fibrous material of the invention.

The nonlinear carbonaceous fibers utilized in this invention are prepared by heat treating suitable stabilized, polymeric precursor fibers in an inert atmosphere until the fibers are substantially or completely irreversibly heat set and transformed into carbonaceous fibers having the physical characteristics such as tensil strength, Young's modulus, etc., as hereinbefore defined. Preferably, the stabilized polymeric precursor fibers used to prepare the carbonaceous fibers are derived from oxidatively stabilized acrylic filaments, preferably polyacrylonitrile (PAN) filaments. The acrylic filaments are selected from one or more of the following: acrylonitrile based homopolymers, acrylonitrile based copolymers and acrylonitrile based terpolymers. The copolymers preferably contain at least about 85 mole percent of acrylonitrile units and up to 15 mole percent of one or more monovinyl units.

Examples of vinyl monomers copolymerizable with acrylonitrile include methacrylic acids esters and acrylic acid esters such as methyl methacrylate, ethyl methacrylate, propyl methacrylate, butyl methacrylate, methyl acrylate and ethyl acrylate; vinyl esters such as vinyl acetate and vinyl propionate; acrylic acid, methacrylic acid, maleic acid, itaconic acid and the salts thereof; vinylsulfonic acid and the salts thereof.

Preferably, when the carbonaceous fibers are derived from PAN precursor fibers and are used to prepare the fibrous material of the invention, they can be classified according to carbon content and electrical conductivity analogous to the three groups disclosed in U.S. Pat. Nos. 4,950,533 and 4,950,545.

In a first group, the carbonaceous fibers are partially carbonized and have a carbon content of greater than about 65% but less than 85% by weight, are electrically nonconductive and do not possess any electrostatic dissipating characteristics, i.e., they are not able to dissipate an electrostatic charge.

The term electrically nonconductive as utilized in the present invention relates to carbonaceous fibers having a log specific resistivity of from about $10^4$ to $10^8$ ohm-cm, or greater. The specific resistivity of the fibers is calculated from measurements as described in U.S. Pat. No. 4,898,783, issued Feb. 6, 1990 to McCullough at al. When the fiber is a stabilized and heat set acrylic fiber it has been found that a nitrogen content of about 22% by weight or higher results in an electrically nonconductive fiber.

In a second group, the carbonaceous fibers are classified as having low electrical conductivity, i.e. the fibers are partially electrically conductive and having a carbon content of greater than about 65% but less than 85% by weight. Low conductivity means that carbonaceous fibers have a log specific resistivity of from about $10^{-2}$ to $10^4$ ohm-cm. When the fibers are derived from stabilized acrylic precursor fibers, they possesses a percentage nitrogen content of from about 16 to 22%, preferably from about 16 to 18.8% by weight.

In a third group, the fibers have a carbon content of at least about 85% but less than 98% by weight, preferably less than 92%, and a Nitrogen content of greater than about 5% by weight. These fibers are characterized as having a high electrical conductivity, that is, the fibers have a log electrical resistivity of from less than about $10^{-2}$ to $10^{-4}$ ohm-cm.

In accordance with another embodiment of the invention, there is provided an improved fire barrier material which comprises the carbonaceous fibers in combination with an organosilicone polymer which is characterized by the following recurring units:

$$(Si—O—Si—O)_n$$

The organosilicone polymer is present as a coating on the carbonaceous fiber surface which can contact a flame and is present in an amount effective to provide a synergistic improvement in the ignition resistance of the fibrous material of the invention without any substantial alteration in the desirable characteristics of the fibrous material, as disclosed in U.S. patent Ser. No. 5,024,877, issued Jun. 18, 1991, to McCoullough et al., incorporated herein by reference. Ignition resistance of the material is determined by test method 14 CFR 25.853(b). The statement "synergistic ignition resistance" is used herein to emphasize that the carbonaceous fibers per se are ignition resistant and that the organosilicone polymer per se is flammable, but that the presence of the organosilicone polymer in combination with the carbonaceous fibers substantially enhances the ignition resistance of the fibrous material.

The organosilicone polymers which are used herein are known in the art and are prepared from precursor silicone resins by a hydrolysis, heat condensation, or free radical reaction. Preferred organosilicone polymers are those which can be prepared by setting or curing a compound selected from the group consisting of the hydrolized partial reaction product of $R_xSi(OR')_{4-x}$ and $R_xSi(OOR')_{4-x'}$, wherein R is an organic radical and R' is a lower alkyl or phenyl radical, and x is at least 1 but less than 4. The amount of organosilicone polymer that is used to impart additional ignition resistance to the carbonaceous fibers depends on whether it is used as a coating on the carbonaceous fibers, or whether it is applied as a coating on the outer surface or surfaces of the fibrous material, or whether it is applied throughout the fibrous material.

Generally, as little a 0.5% by weight of organosilicone polymer improves the ignition resistance of the fibrous material when applied to the carbonaceous fibers and when arranged on a surface of the fibrous material. As much as 30% by weight of the organosilicone polymer, based on the total weight of the carbonaceous fibers in the fibrous structure, can be used when the organosilicone polymer is applied to the carbonaceous fibers distributed throughout the fibrous material. However, amounts of from about 0.5 to 20% by weight based on the total weight of carbonaceous fibers present in the fibrous material have resulted in best performances when tested for ignition resistance, fire resistance, water repellancy and resistance to oxidation, while maintaining the favorable characteristics of the fibrous material of the invention. Application of the organosilicone polymer as a coating to the thermoplastic polymeric fibers is of little benefit as far as the ignition resistance of the fibrous structure is concerned and, accordingly, it is economically more advantageous to apply the organosilicone polymer to the surfaces of the carbonaceous fibers.

Preferably, R in the empirical formulae is selected from lower alkyl, alkenyl, substituted alkyl and aryl. The preferred aryl is phenyl. Most preferred organosilicone polymers are selected from trimethoxymethyl silane, trimethoxyphenyl silane, methoxytrimethyl silane, dimethoxydimethyl silane, and mixtures thereof. Other suitable silicone resins are mentioned in the Dow Corning Corp. brochure entitled "Information about High Technology Materials", 1986

Having thus broadly described the present invention and a preferred embodiment thereof, it is believed that the same will become even more apparent by reference to the following examples. It will be appreciated, however, that the examples are presented solely for purposes of illustration and should not be construed as limiting the invention.

EXAMPLE 1

An ignition resistant batting of the invention is made using a modified meltblown process and an apparatus similar to that of U.S. Pat. No. 4,118,531. The apparatus was manufactured by J&M Laboratories, Gainesville, Ga. Molten polypropylene is extruded through a die having a plurality of orifices, each having a diameter of 0.4 mm. The orifices are equally spaced from each other with 10 orifices per inch (4 orifices/cm). As soon as the polymer emerges from the die, it is drawn away by a stream of hot air contacting the emerging polymer at the exit end of the orifices. The temperature of the air stream at the contact point with the polymer streams emerging from the orifices is the same as the die temperature. The filaments are attenuated to a degree so that the diameter of the filaments is reduced to an average of about 6 microns before they are solidified and collected on a conveyor. Crimped carbonaceous fibers are dispersed into the stream of polymeric filaments emerging from the die by a secondary warm air stream contacting the carbonaceous fibers at a point just before the polymer becomes solidified. The carbonaceous fibers are randomly distributed by the stream of warm air (to prevent undue cooling of the polymeric fibers) onto the meltblown polymeric filaments so as to adhere and bond to the polymeric filaments, which are still soft and sticky, to form a webbed structure. The carbonaceous fibers comprised about 5% by weight based of the total weight of the resulting webbed structure.

Similar results are obtained when a polyester resin, instead of polypropylene, is extruded from the die and the heat softened polyester fibers are mixed with carbonaceous fibers. Other thermoplastic polymeric materials can be meltspun or meltblown and are suitable for preparing the webbed material of the invention.

EXAMPLE 2

In this example, a web is prepared by using the same polymer to that used in Example 1. The meltblowing apparatus is operated at the same conditions previously described except that the air flow rate is increased by about 20 percent. The increase in air flow causes an increase in in the draw or attenuation of the fibers, resulting in an increase in the molecular orientation of the polymer, thereby increasing the tenacity of the fibers. The webbing that is produced contained microdenier fibers having an average diameter of about 5 microns which were somewhat smaller in diameter than the fibers produced in Example 1. The webbing produced in this example has improved thermal insulative properties over that of Example 1 and are increased so that the k value of the webbing went from about 0.27 to 0.22 BTU·in/(hr·ft$^2$·°F.), which is indicative of the fact that the lower the k value, the higher the degree of thermal insulation.

EXAMPLE 3

In this example, a web is prepared by the same procedure as described in Example 1, utilizing polyethylene terephthalate obtained from recycled containers instead of polypropylene. The resulting web is tested for ignition resistance by a vertical burn test pursuant to Federal Test Method FTM 5903, following the test procedure set forth in 14 CFR 25.853(b), which is incorporated herein by reference. A char length of less than one inch (2.5 cm) is formed without the production of any polymeric melt drippings. A comparative sample containing only polyethylene terephthalate meltblown fibers failed, producing a char length of greater than 8 inches (20 cm) and exhibited high flammability and after burn as well as significant dripping of molten polymer.

What is claimed is:

1. An ignition resistant fibrous insulation material comprising the combination of:

a) a multiplicity of meltblown or spunbonded thermoplastic microfibers having an average diameter of less than 15 microns, and b) a multiplicity of nonlinear, nongraphitic carbonaceous fibers having a Young's modulus of at least 300,000 psi and a reversible deflection ratio of greater than 1.2:1, said carbonaceous fibers adhering to said thermoplastic microfibers and being present on at least one surface in an amount of about 1 to 90% by weight of said insulation material or throughout said material in an amount of about 10 to 90% by weight of said material to provide ignition resistance to the insulation material.

2. The insulation material of claim 1, wherein from about 1 to 7.5% by weight of the carbonaceous fibers are randomly distributed on said at least one surface of the material so as to render said surface ignition resistant.

3. The insulation material of claim 1, wherein from about 10 to 90% by weight said carbonaceous fibers are randomly distributed throughout said material so as to render said material ignition resistant throughout.

4. The insulation material of claim 1, wherein said carbonaceous fibers have a bending strain value of less than 50%.

5. The insulation material of claim 1, wherein said carbonaceous fibers have a pseudoelongatability of from about 0.2 to 18 percent, and an elongatability to break of from about 2 to 9 percent.

6. The insulation material of claim 1, wherein said carbonaceous fibers are derived by heat treating stabilized polyacrylonitrile based fibers selected from the group consisting of acrylonitrile homopolymers, acrylonitrile copolymers and acrylonitrile terpolymers.

7. The insulation material of claim 6, wherein said copolymers and terpolymers contain at least 85 mole percent acrylic units and up to 15 mole percent of one or more monovinyl units.

8. The insulation material of claim 1, wherein said carbonaceous fibers have a tenacity of about 2 to 20 g/d.

9. The insulation material of claim 8, wherein said carbonaceous fibers have a tenacity of from about 6 to 19 g/d.

10. The insulation material of claim 1, wherein said thermoplastic microfibers are selected from the group consisting of polyolefin microfibers polyester microfibers, and mixtures thereof.

11. The insulation material of claim 10, wherein said polyolefin is selected from the group consisting of polyethylene and polypropylene.

12. The insulation material of claim 11, wherein said polypropylene has a number average molecular weight of from about 10,000 to 13,000.

13. The insulation material of claim 10, wherein said polyester is polyethylene terephthalate.

14. The insulation material of claim 1, wherein said thermoplastic microfibers are formed by a melt blown process and have an average diameter of from about 5 to about 6 microns.

15. The insulation material of claim 1, wherein said thermoplastic microfibers are formed by a spunbonded process and have an average diameter of from about 6 to 10 microns.

16. The insulation material of claim 1, having a bulk density of from about 0.01 to 0.003 g/cc.

17. The insulation material of claim 1, having a k value of less than 0.33 BTU·in/(hr·ft$^2$·°F.).

18. The insulation material of claim 1, wherein said carbonaceous fibers are coated with an organosilicone polymer having $(Si—O—Si—O)_n$ recurring units for imparting increased ignition resistance to the material.

19. The insulation material of claim 18, wherein said organosilicone polymer is derived from a hydrolyzed partial condensation product of a compound selected from the grouping consisting of $R_xSi(OR')_{4-x}$ and $R_xSi(OOR')_{4-x'}$, wherein R is an organic radical and R' is a lower alkyl or phenyl radical, and x is at least 1 but less than 4.

20. The insulation material of claim 19, wherein R is selected from the group consisting of lower alkyl, alkenyl, substituted alkyl and aryl.

21. The insulation material of claim 19, wherein said organosilicone polymer is selected from the group consisting of trimethoxymethyl silane and trimethoxyphenyl silane.

22. The insulation material of claim 18, wherein said organosilicone polymer is provided in an amount of from about 0.5 to 30% by weight of the total weight of carbonaceous fibers in the material.

23. The insulation material of claim 22, wherein said organosilicone polymer is provided in an amount of from about 0.5 to 20% by weight of the total weight of carbonaceous fibers in the material.

24. The insulation material of claim 1, wherein said carbonaceous fibers have a carbon content of greater than 65% by weight but less than 98% by weight.

25. The insulation material of claim 1, wherein said carbonaceous fibers have a nitrogen content of from about 5 to 35% by weight.

26. The insulation material of claim 24, wherein said carbonaceous fibers are electrically conductive and have a specific resistivity of less than about $10^{-4}$ to $10^{-2}$ ohm-cm.

27. The insulation material of claim 24, wherein said carbonaceous fibers are electrically nonconductive or do not possess any electrostatic dissipating characteristics and have a specific resistivity of from about $10^4$ to $10^8$ ohm-cm, or greater.

28. The insulation material of claim 24, wherein said carbonaceous fibers have a low electrical conductivity and electrostatic dissipating characteristics and a specific resistivity of greater than about $10^{-2}$ to $10^4$ ohm-cm.

29. The insulation material of claim 1, wherein said thermoplastic microfibers have a noncircular cross sectional shape.

30. A composite material comprising a plurality of layers of webbing, batting, or a combination thereof, said composite material comprising the fibrous material as defined in claim 1 and arranged in a superimposed relationship.

31. The building insulation of claim 29, wherein said carbonaceous fibers comprise from about 5 to 20% by weight, based on the total weight of said insulation.

32. A garment containing insulation, wherein said insulation comprises the fibrous insulation material of claim 1.

33. Upholstered furniture containing covers, padding or stuffing, comprising the fibrous insulation material of claim 1.

34. A process for making an ignition resistant fibrous insulation material comprising the steps of:

a) extruding streams of a heat softened thermoplastic polymer through orifices in an extrusion die to form a multiplicity of fibers, b) blowing a stream of heated air into the stream of heat softened fibers to attenuate said fibers and to form microfibers having an average diameter of less than 15 microns, c) introducing a multiplicity of nonlinear, nongraphitic carbonaceous fibers having a Young's modulus of at least 300,000 psi and a reversible deflection ratio greater than 1.2:1 into said stream of thermoplastic microfibers, said carbonaceous fibers adhering to said heat softened thermoplastic microfibers to form said insulation material and being present on at least one surface of said insulation material in an amount of about 1 to 90% by weight of said insulation material or throughout said insulation material in an amount of about 10 to 90% by weight of said material to provide ignition resistance to the fibrous insulation material.

35. The process of claim 34, wherein said thermoplastic microfibers are extruded through orifices having a noncircular cross sectional shape.

* * * * *

UNITED STATES PATENT AND TRADEMARK OFFICE

CERTIFICATE OF CORRECTION

PATENT NO. : 5,407,739

DATED : April 18, 1995

INVENTOR(S) : Francis P. McCullough et al.

It is certified that error appears in the above-identified patent and that said Letters Patent is hereby corrected as shown below:

In claim 10, column 11, line 38, "microfibers", should read --microfibers,--.

In claim 31, column 12, line 46, "building insulation", should read --insulation material--.

Signed and Sealed this

Fifth Day of November, 1996

*Attest:*

Bruce Lehman

BRUCE LEHMAN

*Attesting Officer*

*Commissioner of Patents and Trademarks*